US005438392A

United States Patent [19]

Okada

[11] Patent Number: 5,438,392

[45] Date of Patent: Aug. 1, 1995

[54] IMAGE FIXING APPARATUS WITH ENERGY CUT-OFF

[75] Inventor: Tamotsu Okada, Kawasaki, Japan

[73] Assignee: Canon Kabushiki Kaisha, Tokyo, Japan

[21] Appl. No.: 165,549

[22] Filed: Dec. 13, 1993

Related U.S. Application Data

[63] Continuation of Ser. No. 915,865, Jul. 20, 1992, abandoned, which is a continuation of Ser. No. 602,776, Oct. 24, 1990, abandoned.

[30] Foreign Application Priority Data

Oct. 31, 1989 [JP] Japan ..... 1-284584

[51] Int. Cl.[6] ..... G03G 21/00

[52] U.S. Cl. ..... 355/206; 355/285; 355/290

[58] Field of Search ..... 355/282, 285, 289, 290; 219/216, 469, 471

[56] References Cited

U.S. PATENT DOCUMENTS

| | | | |
|---|---|---|---|
| 3,811,828 | 5/1974 | Ohta et al. | 432/227 |
| 4,232,959 | 11/1980 | Ateya et al. . | |
| 4,473,290 | 9/1984 | Iwao | 219/216 X |
| 4,881,101 | 11/1989 | Sumida | 355/204 |
| 4,954,845 | 9/1990 | Yano et al. | 355/290 |
| 4,965,640 | 10/1990 | Watarai et al. | 355/283 |
| 4,998,121 | 3/1991 | Koh et al. | 346/160 |
| 5,026,276 | 6/1991 | Hirabayashi et al. | 432/59 |
| 5,027,160 | 6/1991 | Okada et al. | 355/282 |
| 5,043,763 | 8/1991 | Koh et al. | 355/206 |

FOREIGN PATENT DOCUMENTS

| | | |
|---|---|---|
| 0295901 | 12/1988 | European Pat. Off. . |
| 57-76582 | 5/1982 | Japan . |
| 57-148776 | 9/1982 | Japan . |

OTHER PUBLICATIONS 3 pgs. European Search Report.

*Primary Examiner*—A. T. Grimley
*Assistant Examiner*—Thu A. Dang
*Attorney, Agent, or Firm*—Fitzpatrick, Cella, Harper & Scinto

[57] ABSTRACT

An image fixing apparatus includes a heater; a film movable together with a recording material in contact with the heater; a pressing member for establishing press-contact between the heater and the film and between the film and the recording medium; and a shutting device for shutting power supply to the heater upon release of the pressure contact.

8 Claims, 2 Drawing Sheets

IMAGE FIXING APPARATUS WITH ENERGY CUT-OFF

This application is a continuation of application Ser. No. 07/915,865 filed Jul. 20, 1992, now abandoned, which in turn is a continuation of application Ser. No. 07/602,776, filed Oct. 24, 1990, also abandoned.

FIELD OF THE INVENTION AND RELATED ART

The present invention relates to an image fixing apparatus, usable with an image forming apparatus, for heat-fixing a toner image on a recording material such as a transfer material, more particularly to a heat-fixing apparatus wherein the image is heat-fixed through a thin film.

As for an image fixing system for fixing a toner image on a recording material by heat, a heat roller type fixing system is widely used in which a recording medium carrying a toner image is passed through a nip between a heating roller and a pressing or back-up roller press-contacted thereto. This system, however, involves the problem that the warming period until the surface of the heating roller reaches a predetermined operable level, is long.

In order to solve the problem, U.S. patent applications Ser. Nos. 206,767, 387,970, 409,341, 416,539, 426,082, 435,247, 440,380, 440,678, 444,802 and 446,449 which have been assigned to the assignee of this application, have proposed a heat-fixing apparatus wherein use is made with a heater having a property of instantaneous temperature rise and a thin film, whereby the warming period is significantly reduced or eliminated.

In the usual heat-roller type fixing system, the pressure-contact between the rollers is released for the purpose of jam clearance. The release upon the jam clearance operation is also effective in the apparatus using the thin film and the heater having the property of quick response, in which, however, there is another problem.

More particularly, if the heater is energized with the released state, the heater or the film is thermally damaged. This is because, the effective thermal capacity of the heater and the body therearound is small when the pressing member having the large capacity is away from the heater, and the heater and the film have low thermal capacities, and because the heat is not released to the other member. In addition, when the press-contact is released, the overshooting of the temperature upon the start of energization of the heater is larger than upon the press-contact state, and therefore, it is predicted that the thermal damage is produced-upon the start of the energization. The possible damage of the heater includes burn-out of the heater (heat generating layer), damage of the heater substrate (alumina substrate, for example), and fusing of a heater retaining layer (heat-resistive resin such as PPS resin). The damage to the film includes burn-out of the film because the heat thereof does not leak to the pressing member.

SUMMARY OF THE INVENTION

Accordingly, it is a principal object of the present invention to provide an image fixing apparatus wherein the pressure-contact between the heater and the film can be released.

It is another object of the present invention to provide an image fixing apparatus wherein the heater and the film can be effectively protected from the thermal damage.

It is a further object of the present invention to provide an image fixing apparatus wherein the energization to the heater is stopped upon release of the pressure-contact.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
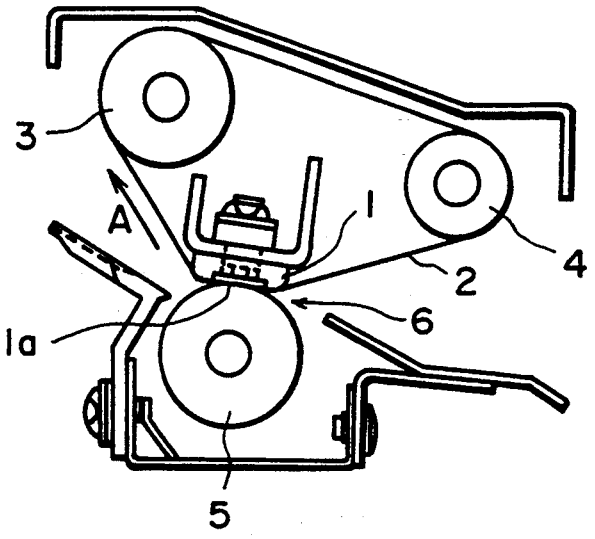
FIG. 1 is a sectional view of an image fixing apparatus according to an embodiment of the present invention.

The description of the preferred embodiments will be made in conjunction with the accompanying drawings wherein like reference numerals are assigned to the elements having the corresponding functions.

Figure 2:
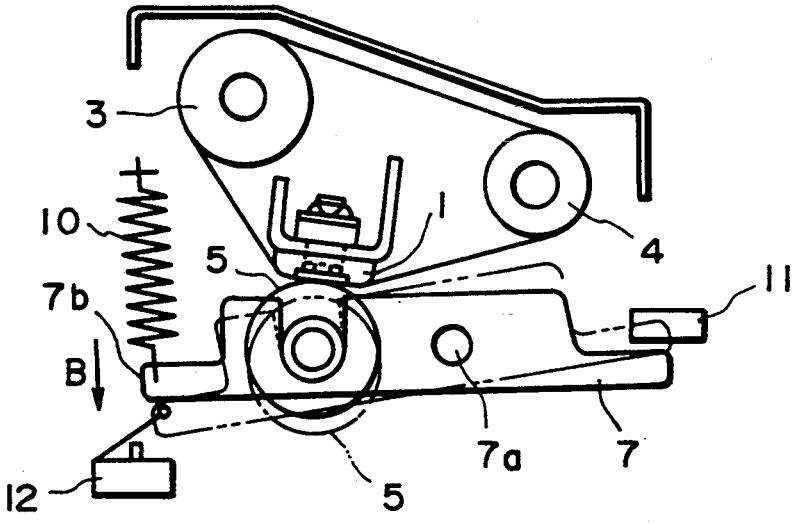
FIG. 2 is a side view of a pressing mechanism used in the apparatus of FIG. 1 embodiment.

Referring to FIG. 1, there is shown an image fixing apparatus according to an embodiment of the present invention. FIG. 2 is a side view of a pressing mechanism used therein.

The image fixing apparatus includes a low thermal capacity heater 1 fixedly mounted on a main assembly of the fixing apparatus, and a heat generating element 1*a* extending in a direction perpendicular to a direction of a recording material movement. The heat generating element 1*a* produces heat by pulse-wise electric power supply thereto. It further includes an image fixing film made of heat resistive material rotatable along an endless path in a direction indicated by an arrow A upon the image fixing operation. It is contacted to the heater 1 and is stretched around a driving roller 3 and a follower roller 4, so that it is tensioned and driven.

The thickness of the film 2 is preferably less than 40 microns, in order to avoid large thermal capacity. A pressing roller 5 has a rubber elastic layer, made of silicone, exhibiting good parting property, and is urged to the fixing film 2 toward the heater 1 by a pressing mechanism shown in FIG. 2. It is driven by an unshown driving mechanism. A recording material (not shown) carrying an unfixed toner image is introduced (from the right side) into a nip 6 formed between the pressing roller 5 and the fixing film 2, by which the unfixed toner image is fixed by the heat.

The pressing roller 5 is rotatably supported on a pressure lever 7 which is rotatable substantially vertically about a pin 7*a* planted on the main frame of the apparatus. The pressure roller 5 is press-contacted to the heater 1 by a spring force of a pressing spring 10 stretched between a movable end of the pressing lever 7 and the main frame.

Therefore, the pressure is released by the rotation of the pressing lever 7 against the spring force of the pressing spring 10 from a pressing position indicated by broken lines in the Figure in a direction indicated by an arrow B. By further downward urging of the pressing lever 7, it is locked by an unshown locking means at a release position. A microswitch 12 is actuated by the movable end 7*b* upon the arrival of the pressing lever 7 at the releasing position, in response to which the heater energizing circuit for supplying electric energy to the heat generating element 1*a* is opened, or in response to which the power source for the main assembly of the image forming apparatus including the fixing apparatus is deactuated, by which the energy supply to the heater 1*a* is stopped.

Accordingly, erroneous power supply to the heater 1 is effectively prevented. In addition, even if the pressure is released during the power supply, the power supply is instantaneously stopped, so that the thermal damage to the heater or the film can be avoided.

The following is the possible alternative. Using a sensor 11 such as a photosensor, the pressure release of the pressing roller 5 is detected on the basis of the position of the pressing lever 7. In response to the detection signal thereof, the power source is deactuated, and/or, an error, for example, is displayed in a display means such as unshown display panel or the like, and/or the signal from the start switch is not accepted.

Figure 3A:
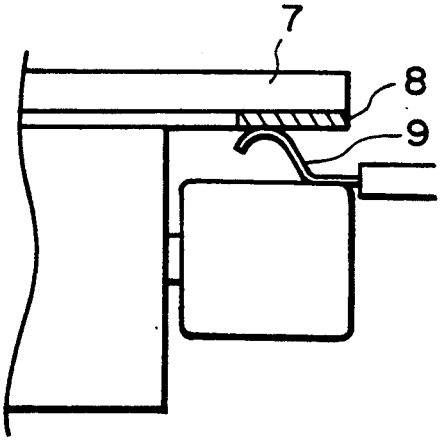
FIGS. 3A and 3B are enlarged view illustrating another embodiment.
Figure 3B:
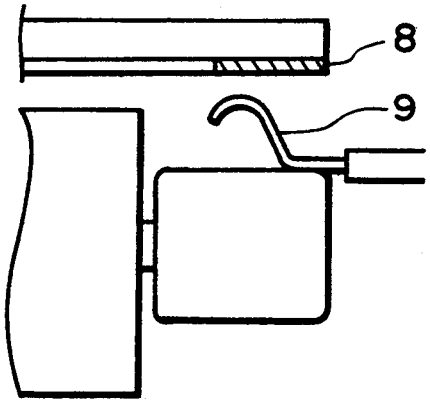

FIG. 3 shows another embodiment, wherein an electrode is provided at an end of the pressing lever 7, and a contact 9 is provided at the main assembly side. The power supply to the heat generating element 1*a* of the heater 1 is started and stopped by the electrode 8 and the contact 9. Thus, the electrode 8 and the contact 9 constitute a switch. When the pressing lever 7 is at the pressing position, the switch is on so that the power supply to the heat generating element 1*a* is effected (FIG. 3A), and when it is at the release position (FIG. 3B), the switch is off so that the power supply to the heat generating element 1*a* is prevented. At this time, the image forming apparatus may be stopped in response to a signal indicative of the "off" of the switch. The photosensor 11 may be further provided so that simultaneously with the stoppage of the power supply, an error is displayed, and the operation of the image forming apparatus is stopped.

Figure 4:
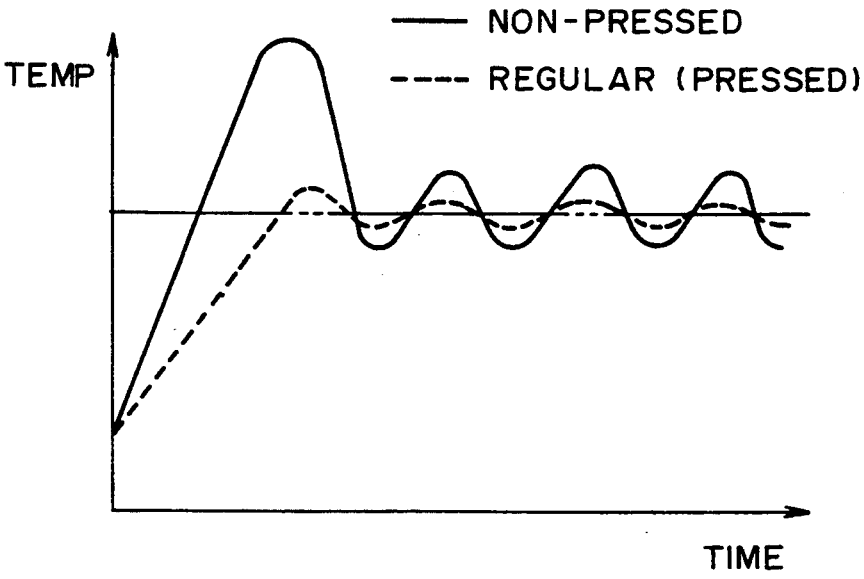
FIG. 4 is a graph showing a temperature rise in the control of the heater.

Referring to FIG. 4, the advantageous effects of the invention will be described. Without the present invention, the heater is energized when the pressure-contact is released with the result of temperature rise as indicated by the solid line. It will be understood that the temperature rise is significantly higher than that upon the energization with the press-contact. Such the significant temperature rise can be prevented by the present invention.

As described in the foregoing, according to the present invention, even if the pressure is erroneously released, or when the pressure is released for the purpose of jam clearance operation, the thermal damage to the heater and the film can be effectively prevented.

While the invention has been described with reference to the structures disclosed herein, it is not confined to the details set forth and this application is intended to cover such modifications or changes as may come within the purposes of the improvements or the scope of the following claims.

What is claimed is:

1. An image fixing apparatus, comprising:

a heater;

a film movable together with a recording material in contact with said heater;

a back-up member for forming a nip with said heater, said film being interposed between said heater and said back-up member; and stopping means for cutting electric power supply to said heater in response to separation between said back-up member and said film, irrespective of movement state of the said film.

2. An apparatus according to claim 1, wherein said back-up member comprises a rotatable member having a rubber layer.

3. An apparatus according to claim 1, wherein said stopping means comprises detecting means for detecting that said back-up member is out of contact with said film, and said stopping means cuts the electric power supply in response to an output of said detecting means.

4. An apparatus according to claim 1, wherein said stopping means comprises a mechanical switch operable in interrelation with a relative position between said back-up member and said film, wherein when said switch is opened by separation between said film and said back-up member, the electric power supply to said heater is cut.

5. An apparatus according to claim 1, wherein said heater is stationary upon operation and comprises a heat generating element for generating heat using the electric power supply, and wherein said heat generating element faces said film.

6. An apparatus according to claim 1, wherein said film comprises an endless belt.

7. An apparatus according to claim 1, wherein said film has a thickness less than 40 microns.

8. An apparatus according to claim 1, further comprising a lever for moving said film and said back-up member apart from each other.

* * * * *

UNITED STATES PATENT AND TRADEMARK OFFICE

CERTIFICATE OF CORRECTION

PATENT NO. : 5,438,392
DATED : August 1, 1995
INVENTOR(S) : TAMOTSU OKADA

It is certified that error appears in the above-indentified patent and that said Letters Patent is hereby corrected as shown below:

Column 1,
line 53, "produced-upon" should read --produced upon--.

Signed and Sealed this

Twenty-fourth Day of October, 1995

*Attest:*

Bruce Lehman

BRUCE LEHMAN

*Attesting Officer*

*Commissioner of Patents and Trademarks*